United States Patent [19]

Ball

[11] 4,407,053

[45] Oct. 4, 1983

[54] COVER FOR CASKETS

[76] Inventor: Alease E. Ball, 6715 Parsons Ave., Baltimore, Md. 21215

[21] Appl. No.: 324,536

[22] Filed: Nov. 24, 1981

[51] Int. Cl.[3] ..... A61G 17/00

[52] U.S. Cl. ..... 27/14

[58] Field of Search ..... 27/2, 7, 3, 14, 15, 27/16, 35, DIG. 1

[56] References Cited

U.S. PATENT DOCUMENTS

| | | | |
|---|---|---|---|
| 586,071 | 7/1897 | Loomis | 27/16 |
| 1,622,777 | 3/1927 | Fleeman | 27/7 |
| 2,431,183 | 11/1947 | Mansfield | 27/3 |
| 2,579,756 | 12/1951 | Reed | 27/7 |
| 3,055,079 | 9/1962 | Flynn | 27/15 |

*Primary Examiner*—John D. Yasko

*Attorney, Agent, or Firm*—John F. McClellan, Sr.

[57] ABSTRACT

A casket-installed guard for guarding a body and for shielding against contagion includes a plastic dome with margins having engagement features that can lock the guard in location sealing the viewing opening in the casket but permitting the viewing top to be in either open position or closed position over it; the margins are proportioned for detachable installation under inwardly overhanging edges and second top of the casket so that they are shielded from tampering; one of the margins has provision for securance of the unit by padlock.

1 Claim, 4 Drawing Figures

FIG. 1
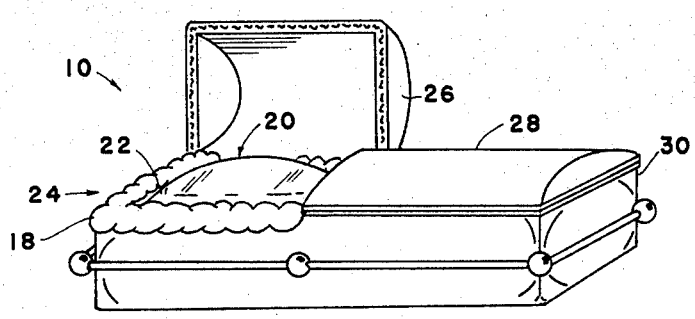
FIG. 2
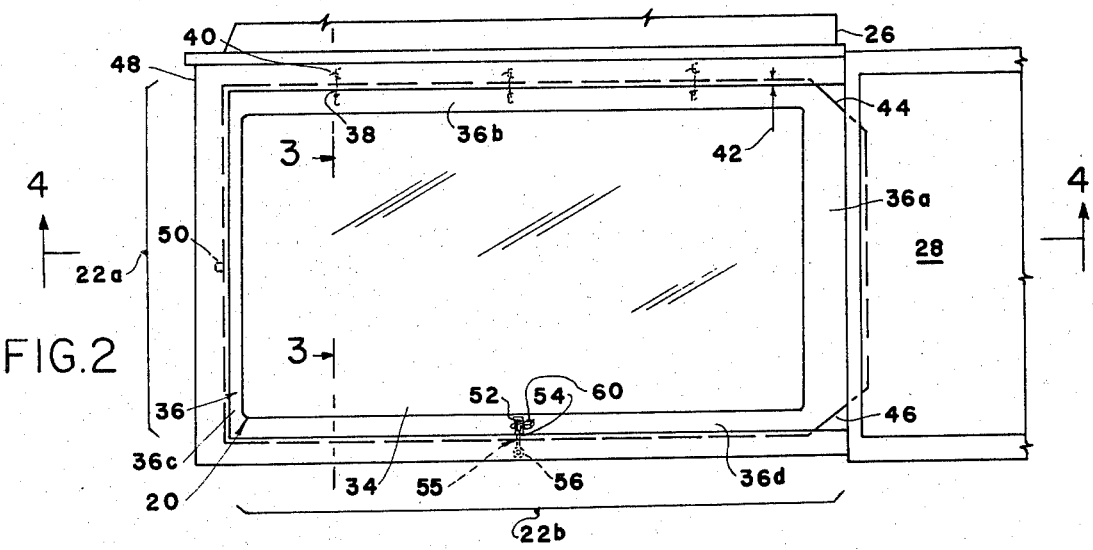
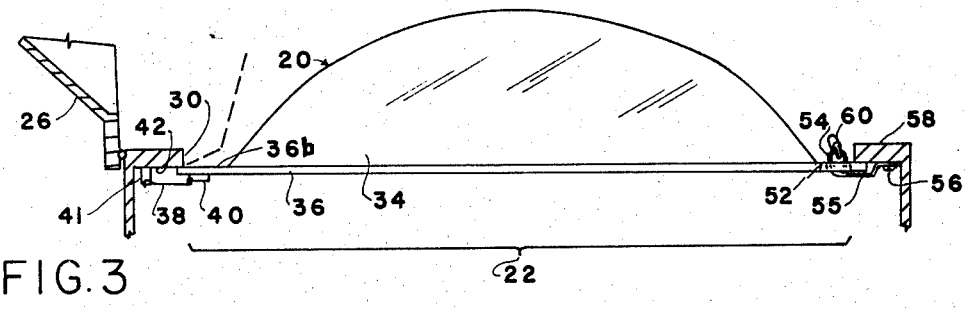
FIG. 3
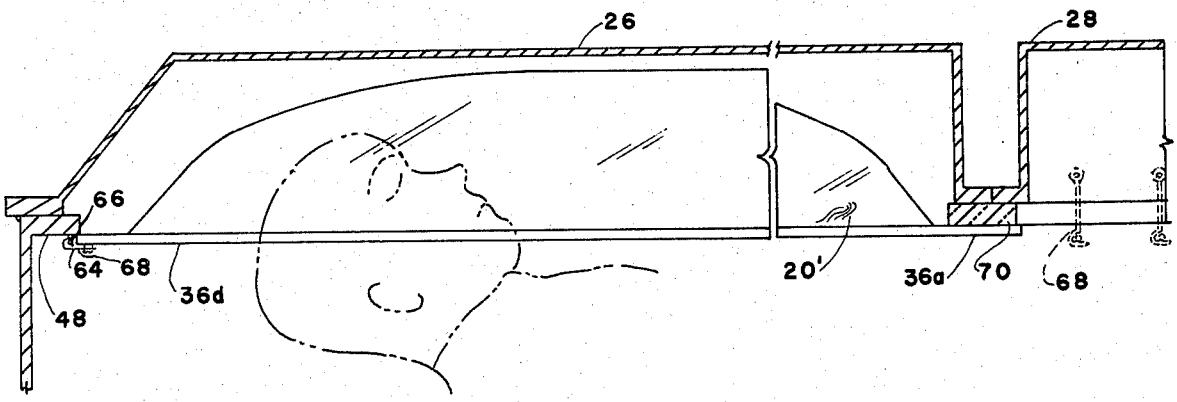
FIG. 4

COVER FOR CASKETS

FIELD OF THE INVENTION

This invention relates generally to funeral caskets and particularly to an accessory cover for caskets. The invention provides a removable casket cover called by the inventor the Guardian Cover or the Guardian Angel.

BACKGROUND OF THE INVENTION

Caskets have been used since ancient times to contain mortal remains of the deceased. Surviving loved ones, relatives, friends and acquaintances, and often strangers with them, come to view the body as part of paying final respects to the deceased and comforting the bereaved. Open-casket viewing and ceremonies are frequently provided. At such times the mourners may touch the body of the deceased out of love, grief, or for some other reason, not thinking of the possibilities of contracting and spreading disease. Embalmers wear protective clothing including mask and rubber gloves, and in the process of embalming cleanse and drain the body, but there is no assurance that the body of the deceased will not transmit some virulent disease or infection such as in many cases that causing the deceased's death. Subsequent embracing and kissing of others among the masses of people attending by those who have contacted the body of the deceased can multiply the spread of contagion.

And further, open caskets expose the body of the deceased to theft of rings, earrings, brooches, necklaces, watches and other valuables and sentimental items intended to be kept with the body of the deceased as symbols of lasting love.

Still further, open caskets sometimes are used even though the remains are properly in the unviewable category, but are placed in full view at the insistence of overwrought survivors, who cannot endure the thought of a closed casket until closed for burial.

PRIOR ART

In the prior art caskets of various materials, including glass-lined and glass-topped caskets have been known, but it is believed that prior to the present invention the objects and advantages of this invention have never been realized.

OBJECTS OF THE INVENTION

Principal objects of the invention are to provide a protective cover to fit directly over the opening of a half-couch casket or of a full couch casket so that the remains can be seen in half view or in full view, partially or clearly as desired.

Further objects are to provide a cover as described which will remain securely in place regardless of whether the casket top is in the open position or is in the closed position.

Still further objects are to provide a cover as described which is substantially tamperproof and unbreakable, lightweight, and which can be made in any size to fit securely in almost any size casket.

And further objects are to provide a cover as described which is handsome in appearance and can easily be engraved with appropriate decorative designs such as guardian angels, memory verses, a picture of the deceased, and name and date of birth.

BRIEF SUMMARY OF THE INVENTION

In brief summary given as cursive description only and not as limitation, the invention includes a convex plastic cover with means including a margin for locking it in place in a casket in position shielding a deceased's body in the casket at all times while permitting viewing to a degree pre-selectable and protecting viewers against contamination by said body.

BRIEF DESCRIPTION OF THE DRAWINGS

FIG. 1 is a perspective view of a typical casket with a top portion in open position disclosing details of the invention;

FIG. 2 is a fragmentary plan diagram of the invention;

FIG. 3 is a detail on a larger scale taken at 3—3, FIG. 2; and

FIG. 4 is a detail on the same larger scale but fragmentary, taken at 4—4, FIG. 2.

DETAILED DESCRIPTION

FIG. 1 shows the invention 10, a guard or cover 20 of plastic material such as plexiglass over the viewing opening 22 of a casket 24 with the first top 26 open and the second top 28 closed.

Typically the first and second tops are hinged at a first side 30 of the casket to operate transversely across the top in abutting relation with each other.

The upper or head end of a body in the casket can be viewed by mourners but not touched, preventing spread of contagion to thieves or even to mourners temporarily deranged by grief.

View of the body is, if desired, practically unobstructed by the cover 20 which has an upwardly domed central portion for the purpose of providing good view, both full face and side view. If the body is "unviewable" a more diffuse material may be used for the cover, such as giving the appearance of cloud or smoke swirls, or even an opaque plastic.

The casket may be otherwise entirely conventional in appearance, with the customary appearance-enhancing features such as that shown at 18, which is deleted in later views for clarity of exposition.

FIG. 2 is a plan diagram of the cover 20 as it relates to the casket details shown around it, when in place.

Proportions of the generally rectangular shape of the cover 20 are such that it can be slid into place within the viewing opening **22*a*, or 22*b*** so that the edges or marginal portions of the cover lie partially beneath overhanging structure of the upper edges of the viewing opening, as will be seen, for locking in place.

The upwardly-domed central portion 34 of the cover has a flat margin 36 extending around it.

Means for locking include the following.

The foot end or first marginal portion **36*a* of the cover may have tapered corners 44, 46 helping proportion it for slipping under the second top 28; this is done first at one corner for assembly. The second marginal 36*b* has hooks 38 that engage eyes 40 beneath the top-edge rail or overhang 42 of the casket. The third marginal portion 36*c* has proportion for slipping under the first end 48 of the casket and may have a fixed upwardly open hook 50 for engaging a square staple keeper under the end of the casket. The fourth marginal portion 36*d* has an opening 52 midway along it for receiving therethrough the loop 54 of a "P"-shaped spring latch 55 with the shank affixed by a screw 56 beneath the second side of the casket in position for extending out with the loop going up through the opening 52 where it is securable by a padlock 60**.

FIG. 3 shows the cover 20 of the invention in place spanning the first and second sides 30, 58 which partially overlap it for security and better sealing. The first top 26 is in the upwardly hinged position. A typical screen-door type swing-hook 38 is slidably and pivotally affixed under the second marginal portion **36*b* by engaging eye or square staple 40. Hook 38 disengageably may be fixed to eye 41 which may be mounted at an angle beneath the overhand 42 of the slide. Hook 38 may be engaged by preliminarily tipping (broken lines) the cover 20, while it is pushed toward the eye 41** for clearance to manipulate the hook. Removal would be by reversing this step.

On the opposite side of the cover, loop 54 of the spring latch 55 or "P" shaped member is shown protruding up through aperture 52 where a padlock 60 secures it; the shank affixation of the latch is shown at 56.

FIG. 4 shows a fragmentary side view of the invention with both tops 26, 28 closed.

This view is interrupted to indicate greater length of the showing in the actual invention.

For installation, after the foot end marginal portion or first marginal portion **36*a* is inserted under the second top 28 which has previously been conventionally secured by hooks 68 indicated in broken lines these may be similar to the hooks and eyes at 38, FIG. 2 and the swing hooks have been engaged as described above, the cover 20 may be slid toward a laterally centered position and then slid under the first end 48, slightly raised, to pass keep 64 (or square staple, shown in section) through the opening 66 in upwardly open hook 68 fixed to the cover, and then slid slightly toward the foot, engaging the hook 68 as shown. At the mid-length of the cover, the padlock loop will then pass up into position for latching. A sealing member 70 (broken lines) may then be laid on the marginal portion 36*a*, if desired. A cloudy or translucent composition is indicated at 20'** as an option.

Thickness of the plastic material may be $\frac{3}{8}$ inch (9 mm). A typical size would be $46\frac{1}{2}$ inches long by 24 inches wide by 5 inches deep (1.1 m by 0.7 m by 0.12 m) with 45° bevels $3\frac{1}{2}$ inches (0.08 m) in length and in width. The viewing opening would be such as to provide a quarter-inch overlap at least, on the two sides and head end and at least one inch at the foot end.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by U.S. Letters Patent is:

1. In combination, an elongate casket having a bottom and first and second sides and first and second ends, forming an opening, first and second tops hinged to the first side for longitudinally abutting over the opening and enclosing a body within the casket; means for detachably securing the second top shut, leaving a viewing opening; said first and second sides and first end and second top forming fixed overhangs around said viewing opening; means for closing the viewing opening for restricting contagion and odors and access to a body in the casket while preserving a selected degree of visual access to said body; means for locking said means for closing the viewing opening, said means for closing the viewing opening comprising a cover having out wardly convex shape and proportioned for permitting said first top to close over the cover, said cover being of transparent material, said cover having margins therearound and having proportion for installation in said viewing opening beneath said second top with said margins therearound beneath respective of said fixed overhangs, the means for locking including a plurality of hooks on said margins, said plurality of hooks engageable from a position beneath the cover at said first side and said first end, the means for locking including a padlock, and said margins having clipped-corner shapes adjacent said second top.

* * * * *